US005324034A

United States Patent [19]

Gottlieb

[11] Patent Number: 5,324,034

[45] Date of Patent: Jun. 28, 1994

[54] IMPACT CONVEYING FLIPPER BUTTON

[75] Inventor: Alvin J. Gottlieb, Elmhurst, Ill.

[73] Assignee: Alvin G. & Co., Melrose Park, Ill.

[21] Appl. No.: 952,360

[22] Filed: Sep. 28, 1992

Related U.S. Application Data

[63] Continuation-in-part of Ser. No. 845,384, Mar. 3, 1992.

[51] Int. Cl.[5] ..... A63F 7/22

[52] U.S. Cl. ..... 273/121 R; 273/121 A; 273/127 R

[58] Field of Search ..... 273/118-125, 273/127

[56] References Cited

U.S. PATENT DOCUMENTS 4,203,602 5/1980 Kral .
4,431,188 2/1984 Hooker .
4,553,748 11/1985 Allen et al. .
4,971,323 11/1990 Gottlieb .
5,064,196 11/1991 Gottlieb .

OTHER PUBLICATIONS

U.S. Patent Application Ser. No. 07/845,384 filed Mar. 3, 1992 by Alvin J. Gottlieb.

*Primary Examiner*—V. Millin
*Assistant Examiner*—Raleigh W. Chiu
*Attorney, Agent, or Firm*—Willian Brinks Hofer Gilson & Lione

[57] ABSTRACT

A pinball machine which includes a ball engaging mechanism is provided such that when a pinball makes contact with a ball engaging mechanism, which propels the pinball, a player feels an impulse from the button that activates the ball engaging mechanism.

39 Claims, 2 Drawing Sheets

IMPACT CONVEYING FLIPPER BUTTON

The present application is a continuation-in-part application of pending U.S. application Ser. No. 07/845,384, filed on Mar. 3, 1992, whose disclosure is incorporated herein by reference.

BACKGROUND OF THE INVENTION

The present invention relates generally to a rolling ball game such as a pinball game, and more particularly to a pinball game having a flipper button which is able to move outward towards the player's fingers in response to the pinball making contact with the flipper or a target. The movement of the flipper button to the player's fingers simulates the impact the player would feel if the flipper button had a direct mechanical connection to the flipper or target.

For years, pinball machines or games have provided a source of leisure time enjoyment for a variety of people. Despite the recent proliferation of computerized video arcades, pinball continues to be recognized as a popular pastime. Pinball games offer the player the ability to manipulate an actual physical object (the ball) as a three-dimensional object as opposed to a character on a two-dimensional screen.

When playing pinball, a player usually sets the ball into play with a spring biased arm or plunger. As the ball strikes various scoring elements, such as post bumpers and slingshot bumpers, the player earns points according to the number of times the ball strikes the bumper and the point value of each bumper. Furthermore, it is common for a pinball game to have certain criteria for a player to attempt to accomplish to earn, for example, a Jackpot, bonus points, free games, and extra pinballs. Examples of the above-mentioned criteria include having the pinball make contact with one or more specific targets or sets of targets. It is common to have visual and audio special effects, such as flashing lights and unusual sounds, to signal that the criteria has been accomplished by the player.

Because the ball rolling or playing surface of the pinball table is gently sloped, the force of gravity constantly urges the ball towards the base of the table. Usually mounted near the base of the table are two flippers that may be electro-mechanically actuated by a player by depressing the buttons located on the side of the machine's cabinet. By correctly timing the actuating of the flippers, the player can cause the flippers to strike the ball and propel it into the playing area to again contact the various scoring elements in order to score further points.

In contrast to the bumpers or other scoring elements, movement of the flippers is within the control of the player. These flippers do not detect ball contact like the bumpers and other scoring elements, however, and no points are scored as a result of contact between the flipper and the ball. The flippers are merely ball propelling devices. The primary purpose of the flipper is to keep the ball in play and prevent it from escaping the playing field by passing through the space located between or around the flippers thereby ending the play of that particular ball. However, a novel flipper mechanism capable of detecting contact with the ball is described in co-pending application Ser. No. 07/392,050, filed Aug. 10, 1989 and in U.S. Pat. No. 4,971,323 whose disclosures are incorporated herein by reference.

When a player plays pinball on a conventional machine as described above, the player is not able to actually feel the ball striking the flipper or a target since the flipper or the target are actually moved by an electro-mechanical device. The lack of feeling sensation of the striking of the flipper or target removes some of the attraction of the device when the ball physically contacts the flipper or target.

Furthermore, lacking the feel of the flipper striking the ball diminishes the player's ability to control the direction of the ball to desired areas of the playing area.

Another disadvantage to such a pinball game is that a player's sight is the only sense in which the player is able to determine when to strike the flipper button. The strength of a player's sight could become the deciding factor in the ability to score well.

Another disadvantage of pinball games is that the only means for a player to determine if a certain criteria of the game has been accomplished is to visually scan the playing surface or the scoring display or to listen for an unusual sound. However, visual scanning or hearing an unusual sound can result in the player losing concentration on the game by losing track of the ball and may result in the drainage of the ball from the playing surface.

In view of the above, it is an objective of this invention to provide a pinball game or machine where a player is imparted a physical stimulus in response to the impact of a projectile, such as a pinball, contacting a projectile sensing mechanism, such as a target or flipper.

It is a further objective of this invention to provide a pinball game or machine where a player is imparted a physical stimulus as part of a special effect produced by the pinball machine to signal to the player the accomplishment of certain criteria of the game.

SUMMARY OF THE INVENTION

To provide these and other objectives the present invention comprises a pinball machine and a method of playing the pinball machine by a player wherein the pinball machine has a projectile move along a playing surface. The pinball machine further comprising a target and an impact transferral mechanism to impart a physical stimulus to the player in response to the projectile contacting the target.

In another embodiment of the present invention, the pinball machine and method of playing the same comprises a projectile sensing mechanism and an impact transferral mechanism to impart a physical stimulus to a player in response to the accomplishment of a criterion of the pinball machine by the player.

The present invention has numerous advantages over pinball games or machines heretofore known in the art. With the present invention, players are able to feel the impact of the projectile sensing mechanism striking the ball. The invention leads to a more exciting game, because the player actually believes that he is part of the game.

The present invention allows people with poor eyesight but quick reflexes to be proficient at the game.

Furthermore, the present invention allows players to learn that they have achieved certain criteria of the game without requiring them to take their eyes off of the pinball as a result of hearing an unusual noise or attempting to visually scan the pinball playing surface or display. Thus, the player is able to concentrate more on the game at hand.

The present invention will be further understood in view of the following detailed description of some presently preferred embodiments of the invention taken in conjunction with the accompanying drawings.

PRESENTLY PREFERRED EMBODIMENT

Figure 1:
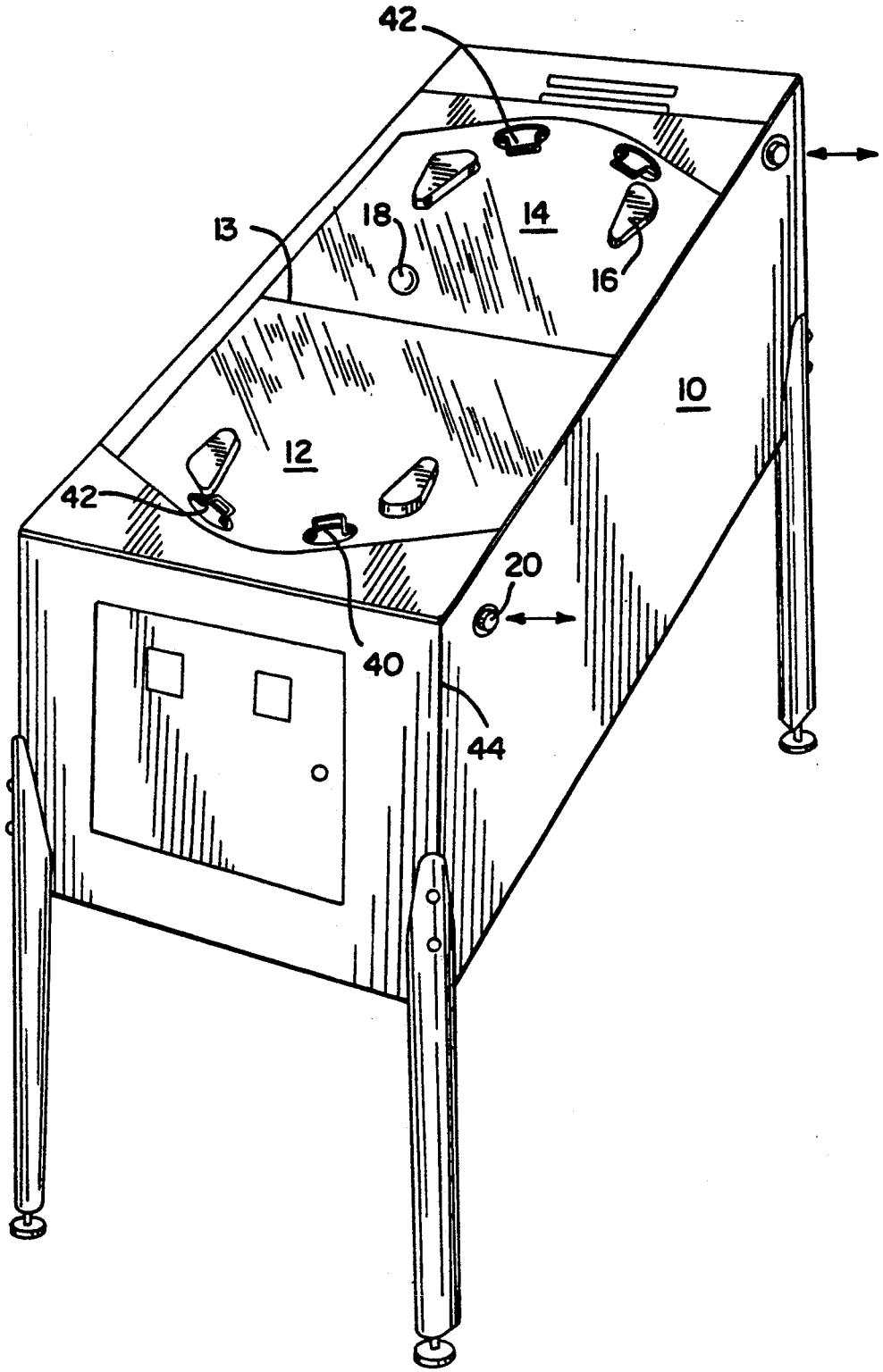
FIG. 1 is a perspective view of a dual-surface pinball table employing a preferred embodiment of the button striking mechanism made in accordance with the present invention.

Reference is now made to the figures wherein FIG. 1 shows a rolling ball game such as a pinball game or pinball machine which preferably contains an impact conveying flipper button 20. FIG. 1 illustrates a preferred embodiment of a multi-surface table employing the present invention. In FIG. 1, a dual-surface pinball table is generally designated as 10. The dual-surface pinball table 10 includes a first playing surface 12 and a second playing surface 14. When playing competitive pinball with a dual-surface pinball table, a first player stands at the outer end of the first playing surface 12, with a second player standing at the outer end of the second playing surface 14.

Both playing surfaces 12 and 14 are originally inclined at opposing angles with respect to the horizontal. Thus, both surfaces 12, 14 meet to form a ridge or apex 13. The ball 18 can roll over the apex 13 onto either playing surface 12, 14.

Although the following description of the invention is directed to a pinball machine, it will be recognized that the invention may be used on other games including games that do not use a "pinball", per se, but use any projectile that moves across a playing surface under its own, or programmed, inertia, such as a puck, cylinder or other figure including a video game "cursor" or the like. It will also be recognized that the invention can be used in single surface pinball games which are well known in the art.

A plurality of projectile-sensing mechanisms 16 are mounted on the playing surfaces 12, 14 shown in FIG. 1. The projectile-sensing mechanisms 16 may include a variety of projectile propelling mechanisms such as post bumpers and slingshot bumpers, as well as other similar ball-engaging mechanisms that are well known in the art.

The projectile sensing mechanisms 16 may include projectile target elements which have a point value assigned to them such that when they are struck with a ball 18 during play of the game the assigned point value is credited to a specific player. The ball-engaging mechanisms 16 may additionally include an element that propels that ball away from the ball-engaging mechanism when contacted by the ball, such as leaf or trigger switches (not shown). Such projectile sensing mechanisms 16 are well known in the art and therefore no further detailed description is given here. A more detailed description and some preferred embodiments of the projectile sensing mechanism comprising a projectile propelling flipper element are disclosed U.S. Pat. No. 4,971,323 and in co-pending application Ser. No. 07/392,050, the contents of which are hereby incorporated by reference.

The pinball machine 10 further includes a plunger which is biased with a spring (not shown), used to propel the ball 18 onto the playing surface 12 for play. The player stands at the end of the machine where the plunger is located. The playing surface 12 is usually sloped at a slight angle with respect to the horizontal so that the ball rolls toward the player. The ball contacts the projectile sensing mechanisms 16, and eventually works its way toward the player.

Additionally, at least a pair of flippers 40 and 42 are provided for each playing surface 12, 14. In a preferred embodiment, these flippers are configured so that they operate independently from each other and sense the projectile. Thus, in one embodiment, two players can operate each flipper simultaneously and in competition with each other. However, when utilizing a dual-surface pinball table 10, it is preferable that the flippers 40 and 42 be configured such that both flippers in a pair correspond to the player standing at that end of the respective playing surfaces 12, 14.

Figure 2:
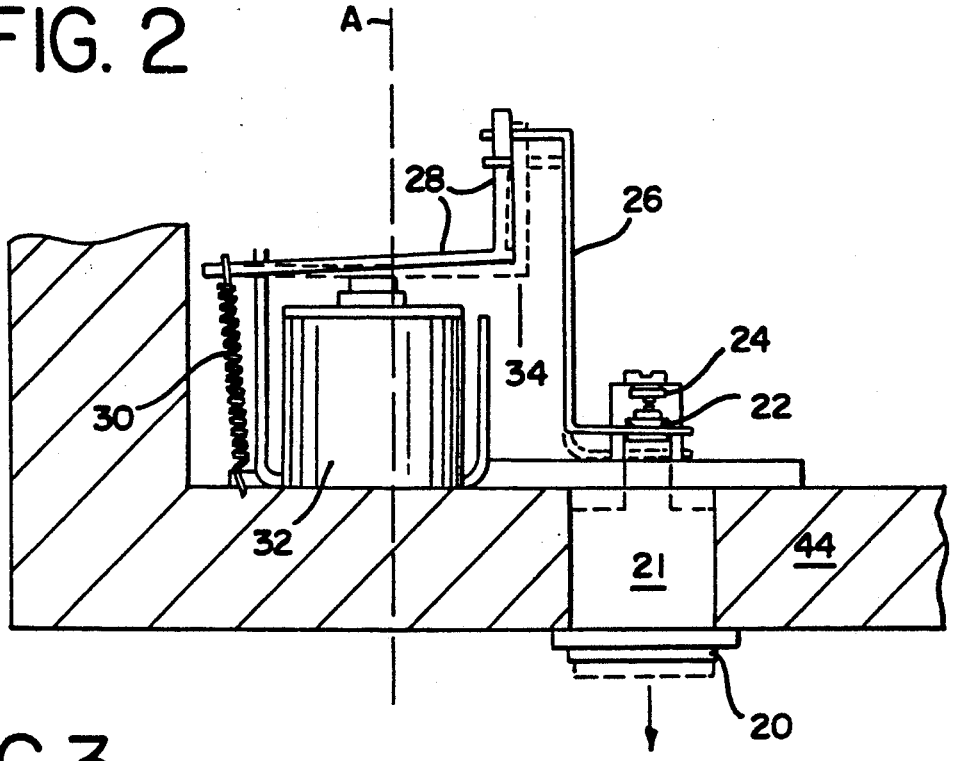
FIG. 2 is a top plan view of that part of a pinball table which employs a preferred embodiment of the button striking mechanism made in accordance with the present invention.
Figure 3:
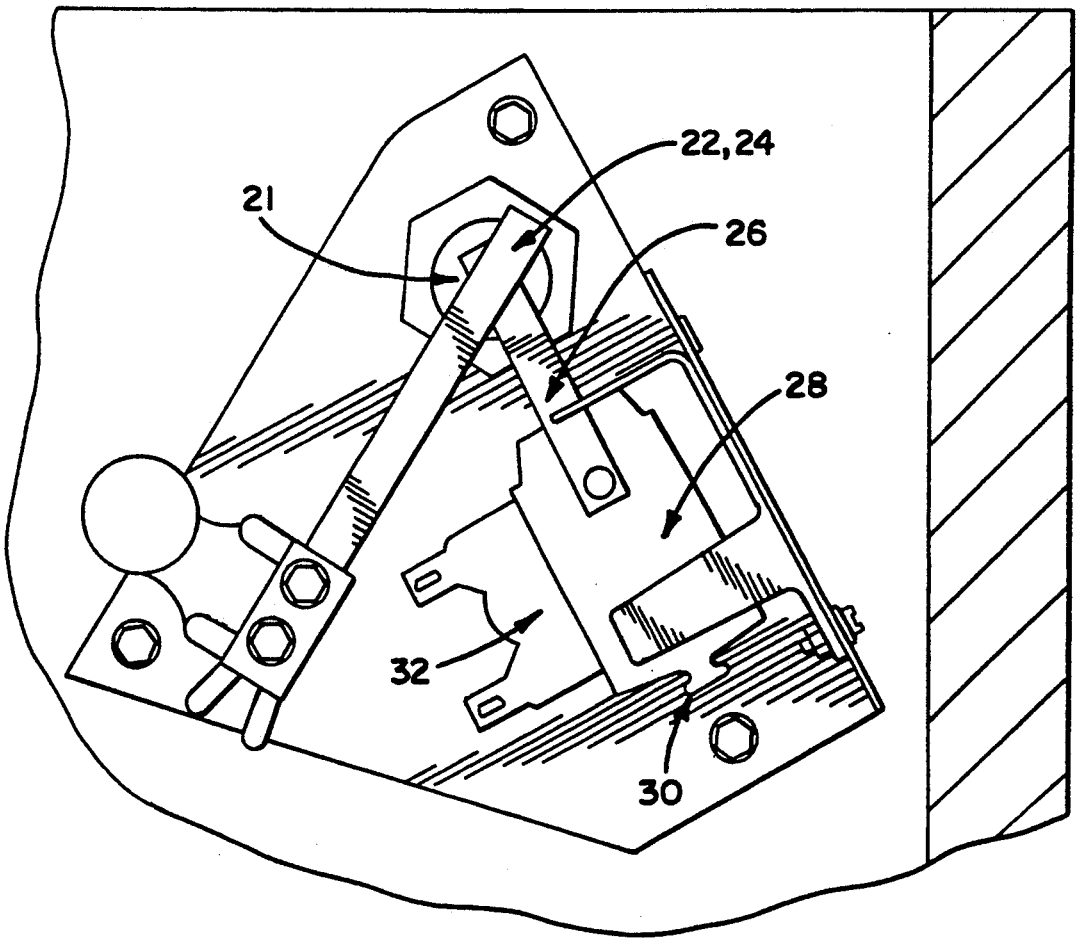
FIG. 3 is a sectional view of the preferred embodiment of a button striking mechanism.

The impact transferral mechanism of a preferred embodiment of the present invention can best be understood by a detailed description of FIG. 2. In FIG. 2 a corner 44 of a pinball machine is exposed in view. At the corner and on the side of the pinball machine is located an activation and movement apparatus such as a button 20. Button 20 is disc shaped and is located outside and on the side of the pinball machine. Button 20 is attached to connector 21 which is generally cylindrical in shape with button 20 located at an outside end of connector 21 and a switch element 22 located at an inside end. The button serves a dual purpose in accordance with the invention. One purpose of the button is to actuate ball engaging mechanism 16 so that when a player presses the button switch element 22 moves toward and makes contact with connector 24. Upon switch element 22 and connector 24 making contact, an activation signal is relayed to ball engaging mechanism 16 enabling it to strike the pinball 18. A second purpose of the button 20 is for the button to move towards the player and provide a physical stimulus of touch to the player in response to the ball 18 contacting the projectile sensing mechanism 16, such as a flipper or a target. A suitable button is commercially available from Wico Distribution Corporation in either a red color as Model No. 15-9129-01 or in a blue color as Model No. 15-9172-01. A suitable switch is commercially from Premier Technology as Model No. 17838.

The physical stimulus is provided once pinball 18 makes contact with projectile sensing mechanism 16 whereupon a feedback signal is fed back to button 20 such that button 20 moves outward towards the player's fingers. The touching of the player by the button 20 allows the player to feel the impact of pinball 18 making contact with either a target or flippers 40, 42. Each target or flipper is electrically connected to an electromagnet 32 which preferably comprises an electromagnetic coil. A suitable electromagnet is available from Premier Technology as Model No. A-19508.

It is also possible to employ software such that when a target or flipper make contact with the pinball the target or flipper produce an electrical signal which is fed to a microprocessor. The software in the microprocessor then generates a signal which is fed to electromagnet 32 to produce the feeling of impact. Furthermore, the software can be programmed to monitor all projectile sensing mechanisms and to determine if a certain criteria of the game has been accomplished. Once the criteria has been accomplished a signal is sent to electromagnet 32 to impart a physical stimulus as part of a special effect produced by the pinball machine to signal to the player the accomplishment of the criteria of the game. Examples of criteria of the game in which a physical stimulus will result is the contact of a single target or flipper by the ball or the contact of all of a plurality targets or flippers by the ball.

Positioned near the electromagnet 32 is an arm 28 which is spring biased to an unactivated position (solid lines) by spring 30. Spring 30 allows button 20 to be moved towards the player's fingers from the unactivated position and to be moved towards switch element 22. A second arm 26 is connected both to arm 28 and contacting element 22 located at the inner end of button 20. When the pinball 18 makes contact with ball engaging mechanism 16 an electrical signal pulse is imparted to electromagnet 32. The electrical signal energizes the electromagnetic coil of electromagnet 32 such that the arm 28 is attracted towards the electromagnet in a downward direction illustrated by arrow 34 and the dashed lines of FIG. 1.

The movement of arm 28 results in arm 26 making a similar downward movement such that the button which is connected to arm 26 moves outwardly toward a player's fingers. The electrical signal pulse is of a short duration which results in the movement of the button 20 also being of a short duration of approximately 0.5 seconds. Consequently, the button 20 simulates the striking of the pinball by ball engaging mechanism 16 as if the button 20 had a direct mechanical connection with ball engaging mechanism 16. However, one of ordinary skill would understand that the electromagnet 32 would allow a player to feel an accentuated physical stimulus of touch having a magnitude that is greater than any natural vibrations produced solely by the ball contacting the projectile sensing mechanism 16. In addition, the short duration of the pulse allows the player to feel impact of the ball and to still easily operate the button 20.

The invention may be embodied in other forms than those specifically disclosed herein without departing from its spirit or essential characteristics. The described embodiments are to be considered in all respects only as illustrative and not restrictive, and the scope of the invention is commensurate with the appended claims rather than the foregoing description.

I claim:

1. A pinball machine to be played by a player having a projectile move along a playing surface, a target; and an impact transferral mechanism to impart an accentuated physical stimulus of touch to the player in response to the projectile contacting the target, wherein the magnitude of the accentuated physical stimulus of touch is greater than any natural vibrations produced solely by the projectile contacting the target.

2. The pinball machine of claim 1, further comprising an arm to move in response to the projectile making contact with the target and to activate the impact transferral mechanism.

3. The pinball machine of claim 2, further comprising an electromagnet which is energized upon the projectile making contact with the target, wherein the energized electromagnet moves the arm to activate the impact transferral mechanism.

4. The pinball machine of claim 3, wherein the impact transferral mechanism comprises a button.

5. The pinball machine of claim 2, wherein the impact transferral mechanism comprises a movement apparatus which moves towards the player and provides the physical stimulus of touch to the player in response to the projectile contacting the target.

6. The pinball machine of claim 5, wherein the impact transferral mechanism comprises a button which provides the physical stimulus of touch to the player.

7. The pinball machine of claim 6, wherein the button when pressed by the player controls the projectile propelling mechanism.

8. The pinball machine of claim 7, wherein the projectile propelling mechanism comprises a flipper element.

9. The pinball machine of claim 1, wherein the impact transferral mechanism comprises a movement apparatus which moves towards the player and provides the physical stimulus of touch to the player in response to the projectile contacting the target.

10. The pinball machine of claim 9, wherein the movement apparatus comprises a button which provides the physical stimulus of touch to the player.

11. A pinball machine to be played by a player having a projectile move along a playing surface, comprising:

a projectile sensing mechanism; and an impact transferral mechanism to impart an accentuated physical stimulus of touch to the player in response to the accomplishment of a criterion of the pinball machine, wherein the magnitude of the accentuated physical stimulus of touch is greater than any natural vibrations produced solely by the projectile contacting the projectile sensing mechanism.

12. The pinball machine of claim 11, wherein said criterion is the contact of said projectile sensing mechanism by said projectile.

13. The pinball machine of claim 11, comprising a plurality of said projectile sensing mechanisms, wherein said criterion is the contact of all of said plurality of said projectile sensing mechanisms by said projectile.

14. The pinball machine of claim 11, further comprising an arm to move in response to the projectile making contact with the projectile sensing mechanism and to activate the impact transferral mechanism.

15. The pinball machine of claim 14, further comprising an electromagnet which is energized upon accomplishment of said criterion, wherein the energized electromagnet moves the arm to activate the impact transferral mechanism.

16. The pinball machine of claim 15, wherein the impact transferral mechanism comprises a button.

17. The pinball machine of claim 14, wherein the impact transferral mechanism comprises a movement apparatus which moves towards the player and provides the physical stimulus of touch to the player in response to accomplishment of the criterion.

18. The pinball machine of claim 17, wherein the impact transferral mechanism comprises a button which provides the physical stimulus of touch to the player.

19. The pinball machine of claim 18, wherein the button when pressed by the player controls the projectile propelling mechanism.

20. The pinball machine of claim 19, wherein the projectile propelling mechanism comprises a flipper element.

21. The pinball machine of claim 11, wherein the impact transferral mechanism comprises a movement apparatus which moves towards the player and provides the physical stimulus of touch to the player in response to accomplishment of the criterion.

22. The pinball machine of claim 21, wherein the movement apparatus comprises a button which provides the physical stimulus of touch to the player.

23. A pinball machine to be played by a player having a projectile move along a playing surface, comprising:

a target; and an impact transferral mechanism comprises a movement apparatus which moves towards the player and imparts a physical stimulus of touch to the player in response to the projectile contacting the target.

24. The pinball machine of claim 23, wherein the movement apparatus comprises a button which provides the physical stimulus of touch to the player.

25. The pinball machine of claim 24, wherein the button when pressed by the player controls the projectile propelling mechanism.

26. The pinball machine of claim 25, wherein the projectile propelling mechanism comprises a flipper element.

27. A pinball machine to be played by a player having a projectile move along a playing surface, comprising:

a plurality of projectile sensing mechanisms; and an impact transferral mechanism to impart a physical stimulus to the player in response to the accomplishment of the criterion of contacting all of said plurality of said projectile sensing mechanisms by said projectile.

28. A pinball machine to be played by a player having a projectile move along a playing surface, comprising:

a projectile sensing mechanism; and an impact transferral mechanism comprising a movement apparatus which moves towards said player and imparts a physical stimulus of touch to the player in response to the accomplishment of a criterion of the pinball machine.

29. The pinball machine of claim 28, wherein the movement apparatus comprises a button which provides the physical stimulus of touch to the player.

30. The pinball machine of claim 29, wherein the button when pressed by the player controls the projectile propelling mechanism.

31. The pinball machine of claim 30, wherein the projectile propelling mechanism comprises a flipper element.

32. A method of playing a pinball game which comprises a projectile to move along a playing surface, a projectile sensing mechanism, and an impact transferral mechanism to impart an accentuated physical stimulus of touch to a player, wherein the method of playing comprises the steps:

a. moving the projectile along the playing surface; and b. imparting an accentuated physical stimulus of touch to said player upon said projectile making contact with said projectile sensing mechanism, wherein the magnitude of the accentuated physical stimulus of touch is greater than any natural vibrations produced solely by the projectile contacting the projectile sensing mechanism.

33. The method of playing a pinball game of claim 32, wherein in said projectile sensing mechanism comprises a target.

34. The method of playing a pinball game of claim 32, wherein said projectile sensing mechanism comprises a flipper.

35. A method of playing a pinball game which comprises a projectile to move along a playing surface, wherein said pinball game has a criterion to be attained by a player, wherein the method of playing comprises the steps:

a. moving the projectile along the playing surface; and b. imparting an accentuated physical stimulus of touch to said player upon attainment of said criterion by said player, wherein the magnitude of the accentuated physical stimulus of touch is greater than any natural vibrations produced solely by the projectile contacting the projectile sensing mechanism.

36. The method of playing pinball of claim 35, wherein said pinball game comprises a projectile sensing mechanism and said method comprises the step of:

c. the projectile making contact with the projectile engaging mechanism to attain said criterion.

37. The method of playing pinball of claim 35, wherein said pinball game comprises a plurality of projectile sensing mechanisms and said method comprises the step of:

c. the projectile making contact with all of the plurality of projectile engaging mechanisms to attain said criterion.

38. A method of playing a pinball game which comprises a projectile to move along a playing surface, a projectile sensing mechanism comprising a flipper, and an impact transferral mechanism to impart a physical stimulus to a player, wherein the method of playing comprises the steps:

a. moving the projectile along the playing surface; and b. imparting a stimulus to said player upon said projectile making contact with said projectile sensing mechanism.

39. A method of playing a pinball game which comprises a projectile to move along a playing surface, and a plurality of projectile sensing mechanism, wherein said pinball game has a criterion to be attained by a player, wherein the method of playing comprises the steps:

a. moving the projectile along the playing surface;

b. the projectile making contact with all of the plurality of projectile engaging mechanisms to attain said criterion; and c. imparting a stimulus to said player upon attainment of said criterion by said player.

* * * * *